US006901856B1

(12) United States Patent
Schneider et al.

(10) Patent No.: US 6,901,856 B1
(45) Date of Patent: Jun. 7, 2005

(54) INKING SYSTEM COMPRISING ROLLERS

(75) Inventors: Georg Schneider, Würzburg (DE); Wolfgang Otto Reder, Veitschöchheim (DE); Bernd Kurt Masuch, Kürnach (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/474,039

(22) PCT Filed: Feb. 7, 2002

(86) PCT No.: PCT/DE02/00440

§ 371 (c)(1),
(2), (4) Date: Mar. 3, 2004

(87) PCT Pub. No.: WO02/083422

PCT Pub. Date: Oct. 24, 2002

(30) Foreign Application Priority Data

Apr. 11, 2001 (DE) ..... 101 18 132

(51) Int. Cl.[7] ..... B41F 31/00
(52) U.S. Cl. ..... 101/350.3; 101/DIG. 38
(58) Field of Search ..... 101/350.3, DIG. 38, 101/375, 348, 148, 187

(56) References Cited

U.S. PATENT DOCUMENTS

| | | | | | |
|---|---|---|---|---|---|
| 309,220 | A | * | 12/1884 | Gally | 101/208 |
| 516,620 | A | * | 3/1894 | Waterston | 101/205 |
| 1,675,448 | A | * | 7/1928 | Carson | 101/187 |
| 2,189,073 | A | * | 2/1940 | Levine | 101/348 |
| 5,119,726 | A | | 6/1992 | Dorsam | |
| 5,351,614 | A | * | 10/1994 | Depa | 101/148 |
| 5,383,394 | A | * | 1/1995 | Izume | 101/350.3 |
| 5,406,886 | A | | 4/1995 | Schneider et al. | |
| 5,713,284 | A | * | 2/1998 | Voeltner et al. | 101/375 |
| 5,845,574 | A | | 12/1998 | Dilling et al. | |
| 6,129,017 | A | | 10/2000 | Mohrmann et al. | |
| 6,349,644 | B1 | * | 2/2002 | Mohrmann et al. | 101/351.6 |
| 6,398,701 | B1 | | 6/2002 | Mohrmann | |

FOREIGN PATENT DOCUMENTS

| | | |
|---|---|---|
| DE | 39 31 291 C1 | 4/1991 |
| DE | 43 00 683 A1 | 7/1994 |
| DE | 196 28 647 A1 | 1/1998 |
| DE | 196 28 648 C1 | 2/1998 |
| WO | WO 98/28141 | 7/1998 |
| WO | WO 98/28142 | 7/1998 |

* cited by examiner

*Primary Examiner*—Eugene H. Eickholt
(74) *Attorney, Agent, or Firm*—Jones Tullar & Cooper PC

(57) ABSTRACT

An inking system is comprised of rollers. At least one roller has a barrel with at least two separate sections. One of these casing sections is arranged in a manner which permits it to be changed independently of the other casing section.

22 Claims, 8 Drawing Sheets

INKING SYSTEM COMPRISING ROLLERS

FIELD OF THE INVENTION

The present invention is directed to an inking unit with rollers. At least one of the rollers has a pad or barrel with two separated roll or casing sections.

BACKGROUND OF THE INVENTION

Inking units of the type, shown, for example in e.g. from DE 196 28 648 C1, can be employed, for example, but not exclusively, as inking units of rotary printing presses that can be switched between panorama printing and printing of multiple, separate pages, especially in different colors. Panorama printing refers to the printing of an image across two pages of a newspaper without interrupting the image. A printing press that, for example is four pages wide, is thus able, during panorama printing, to print two panorama images, each of which extends across two pages. When a printing unit is converted from panorama printing to printing multiple, separate, adjoining pages, or vice versa, conversion work of various kinds must be performed on the inking unit, since, in panorama printing, the space between two adjoining pages is printed and, consequently must be supplied with ink, whereas, when printing separate pages, this region between the pages must be maintained free of ink.

The conversion of the inking unit can, for example, be achieved, by exchanging the entire inking unit, but this represents a considerable conversion expense. To reduce the required expense of conversion, ink transport rollers are shown in DE 196 28 647 A1, that have a recess present between each set of adjoining, cylindrical sections. This recess can be selectively closed, for example, by the application of a covering strip. If a number of separate pages are to be printed alongside one another, and independently of one another, the recess between the different roll surface sections can prevent any running of the ink between the separate pages. In contract, when converting the inking unit to panorama printing, the recess is closed by the covering element, so that a continuous roll surface is obtained, with which an ink layer extending continuously over two pages can be transferred.

WO 98/28141 A1 discloses a roller for a printing press in which the recess between the separate roll surface sections is formed by accomplishing a shifting of the separate sections relative to one another. The separate sections can be formed, for example, in the manner of sleeves arranged on a common shaft. In a first mode of operation, that is suitable for panorama printing, the two sleeves are secured on the shaft such that their end surfaces bear against one another and thereby form a continuous roll surface. For the printing of separate, adjoining pages, the sleeves can be pushed apart, so that a recess is formed between the roll surface sections of the sleeves.

WO 98/28142 A1 discloses a roller for a rotary printing press. A roll surface, which is formed by a rubber-elastic cover, is selectively dividable by a ring-shaped constriction, whose diameter can be reversibly reduced.

Inking units which are suitable for use in printing presses that can be switched between panorama printing and printing of separate pages all have in common that for a surface to have a continuous print, thus either as a separate page or as a double page in panorama printing, separated ink supply paths are always provided. The separate ink supply paths or strands are separated from one another by recesses in the roll surface sections of the rollers being used. In converting between panorama printing and the printing of separate pages, or vice versa, as the case may be, the two separated ink supply paths or strands must either be separated, or must be joined together with one another, which joining together happens either by pushing neighboring roll surface sections together, or by covering of recesses situated between the surface sections.

DE 43 00 683 A1 discloses an inking unit. A second roller is displaceable together with a first roller.

DE 39 31 291 C1 describes a roller driven by a distribution cylinder. An oscillating movement of the roller can be turned off.

SUMMARY OF THE INVENTION

The present invention is directed to providing an inking unit with rollers.

The object is attained in accordance with the present invention, by the provision of an inking unit having rollers in which at least one roller has a pad or barrel that is formed with at least two separate roll sections. At least one of these roll sections is arranged for oscillation independently of the other roll section.

In the inking unit in accordance with the present invention, at least two rollers are engaged with one another, with a first roller of the at least two rollers being journaled such that it can be displaced in a longitudinal direction of the roller. A second roller is also journaled to be axially displaceable in a longitudinal direction of the roller. The second roller can also be axially fixed by the actuation of appropriate locking means.

An advantage which is obtainable with the present invention resides, in particular, in that, in switching between panorama printing and the printing of separated pages, or vice versa, as the case may be, a conversion is required therefor, in which that the second roller, configured for a first mode of operation, in which separate pages are printed separately from one another, is journaled to be axially displaceable, and, in a second mode of operation, which is chosen for panorama printing, is axially fixed. The separation of the separate ink paths or strands which are transferred by the rollers and which are required for the printing of separate pages, is accomplished by having the two rollers each be axially displaceable in the first mode of operation and to thereby avoid a relative movement between the two rollers in the axial direction. Because of the absence of any relative movement in the axial direction, the ink applied on the roll surfaces is not rubbed or shifted in the longitudinal direction. Despite the presence of an uninterrupted roll surface, an errant running of the ink is essentially prevented. If it is then desired to execute a panorama print in the printing press, the second roller is fixed axially, so that the first roller now does execute an axial movement relative to the second roller. Through this axial or longitudinal shifting of the first roller relative to the second roller, the ink transferred in the contact zone between the rollers is rubbed or shifted on the roll surfaces, so that, by using a sufficient stroke or length of axial shifting, any ink-free zone on the roll surface can be covered with ink being brought into the zone incoming from the sides of the zone.

BRIEF DESCRIPTION OF THE DRAWINGS

Preferred embodiments of the present invention are presented in the drawings and will be described in greater detail below.

The drawings show in.

DESCRIPTION OF THE PREFERRED EMBODIMENTS

Figure 1:
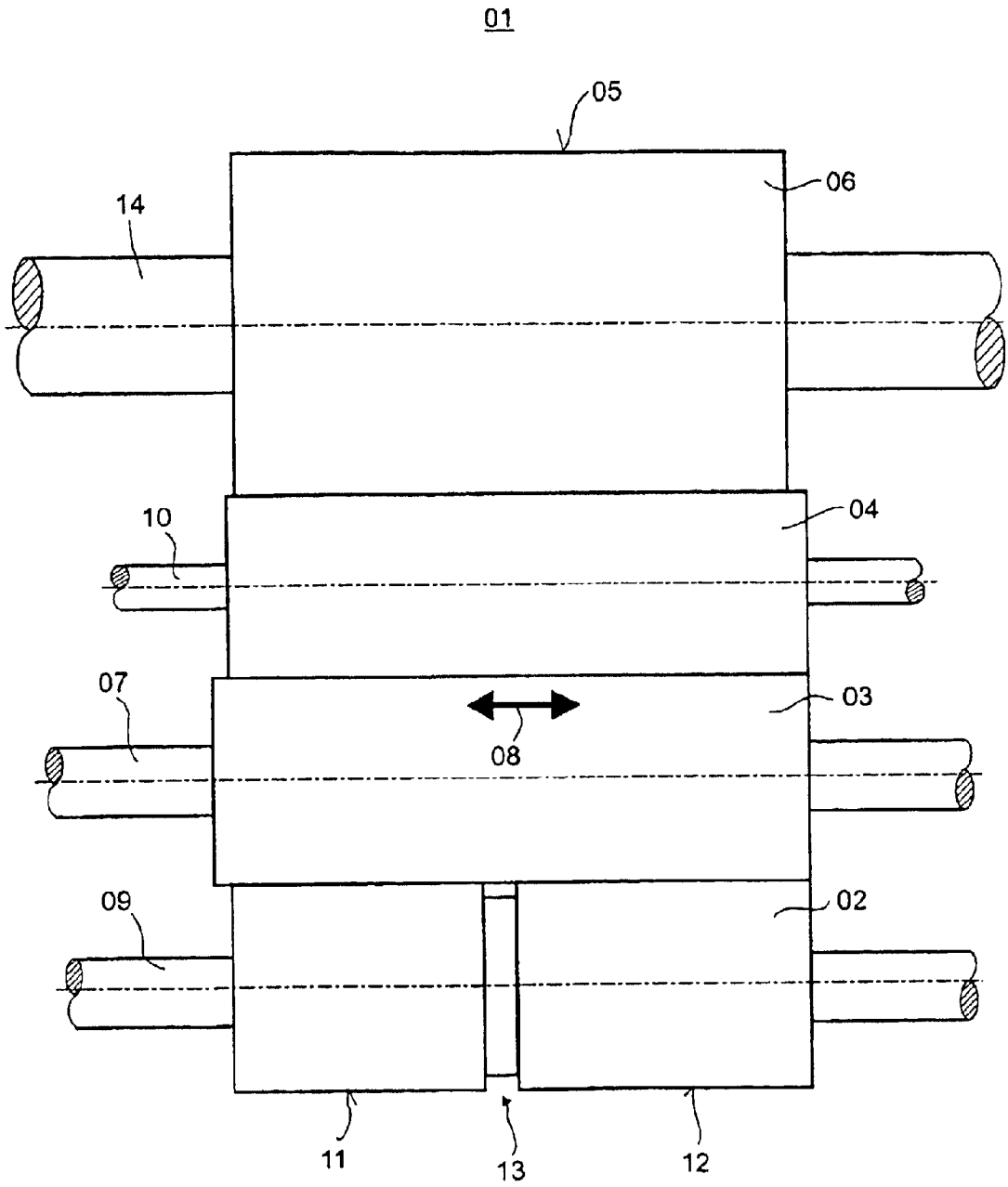
FIG. 1 a schematic front view of a first preferred embodiment of an inking unit in accordance with the present invention in a first mode of operation.

Referring initially to FIG. 1, there may be seen generally at 01, a first preferred embodiment of an inking unit with rollers in accordance with the present invention. The inking unit 01 is formed utilizing four rollers 02, 03, 04, 06. The first roller 03 is configured in the manner of a distribution cylinder 03, and exhibits an uninterrupted, or a continuous, roll surface. This first roller or distribution cylinder 03 is journaled rotatably on a shaft 07 and can be driven axially in a longitudinal direction of the shaft 07 by a drive mechanism which is not specifically shown and which causes roller 03 to oscillate longitudinally in its axial direction in the direction of arrow 8 about a middle or center position. The second roller 04 is formed in the manner of an ink forme roller, which is journaled rotatably on a shaft 10 and which likewise has a continuous roll surface. The journaling of the roller 04 on shaft 10 allows the roller 04 selectively to be fixed axially on the shaft 10 or to be displaced axially along shaft 10 between two end stops, which are not specifically shown. The third roller 02 is formed in the manner of an ink metering roller, and is journaled rotatably on a shaft 09. The third roller 02 is configured having two separated roll sections 11, 12, which are separated from one another by a centrally interposed, circumferential recess 13. The fourth roller 06 of the inking unit 01 is formed in the manner of a plate cylinder, on which a printing plate 05, that is suitable for panorama printing, is secured. The fourth roller or plate cylinder 06 is likewise journaled rotatably on a shaft 14.

FIG. 1 depicts the inking unit 01 in an operating configuration which is suited for panorama printing. For this purpose, the printing plate 05, which is secured on the fourth roller 06, is provided with a continuous roll surface. This printing plate 05 carries the image of two adjoining pages, and is thus suited for use in panorama printing where the intermediate space between the pages is to be printed without interruption. The ink required for such panorama printing is first supplied onto the two spaced roll sections 11, 12 of the third roller 02, for example by application of such ink from two separated ink troughs, not specifically shown and each containing the same printing ink. Since the two roll sections 11, 12 are separated from one another by the recess 13, the printing ink is transferred from the second roller 02, in two separated contact zones, onto the surface of the first roller 03. The transfer of the printing ink from the first roller 03 onto the second roller 04, or from the second roller 04 onto the printing plate 05 which is carried on the fourth roller 06, as the case may be, then proceeds always in continuous contact zones. In order to be able to achieve a uniform printed image over the entire width of the panorama page, the printing ink, which is transferred, separated at the third roller 02 by the roll sections 11, 12, must be distributed or spread, so that the ink-free region caused by the recess 13 becomes filled with ink. This is effected by providing an oscillating stroke motion 08 of the first roller 03, which is configured in the form of a distribution cylinder 03. While the second roller 04 and the third roller 02 each rotate about their rotation axes, but remain axially fixed, the distribution cylinder 03 oscillates in a longitudinal direction with respect to its axis of rotation, as indicated by the motion arrow 08, about a middle or central position. This longitudinal oscillation of the distribution cylinder 03 causes the printing ink, both in the contact zone between the first roller 03 and the third roller 02, and in the contact zone between the first roller 03 and the second roller 04 to be rubbed or distributed evenly on the roll surfaces, so that, in the contact zone between the second roller 04 and the fourth roller 06, an essentially uniform ink application occurs over the entire width of the printing plate 05.

The ink application onto the fourth roller 06 and thus on the printing plate 05 will occur more uniformly, the stronger the printing ink is rubbed between the first roller 03 and the second roller 04 on the one side, and between the first roller 03 and the third roller 02 on the other side. The measure or the extent of the printing ink rubbing or distribution depends especially on the length of the longitudinal stroke 08 of the first roller 03 relative to the second roller 04 and relative to the third roller 02. In order to be able to reliably fill the ink-free region formed by recess 13 with ink, the stroke distance or length 08 of the first roller 03 for panorama printing should equal at least half of the width of the recess 13. In the first preferred embodiment depicted in FIG. 1, the recess 13 is fifteen millimeters wide and the first roller 03 can be axially displaced through a stroke distance or length 08 lying in the range of +/− 5 mm to +/− 10 mm, especially +/− 7.5 mm, out of a middle or central position, in both directions.

Figure 2:
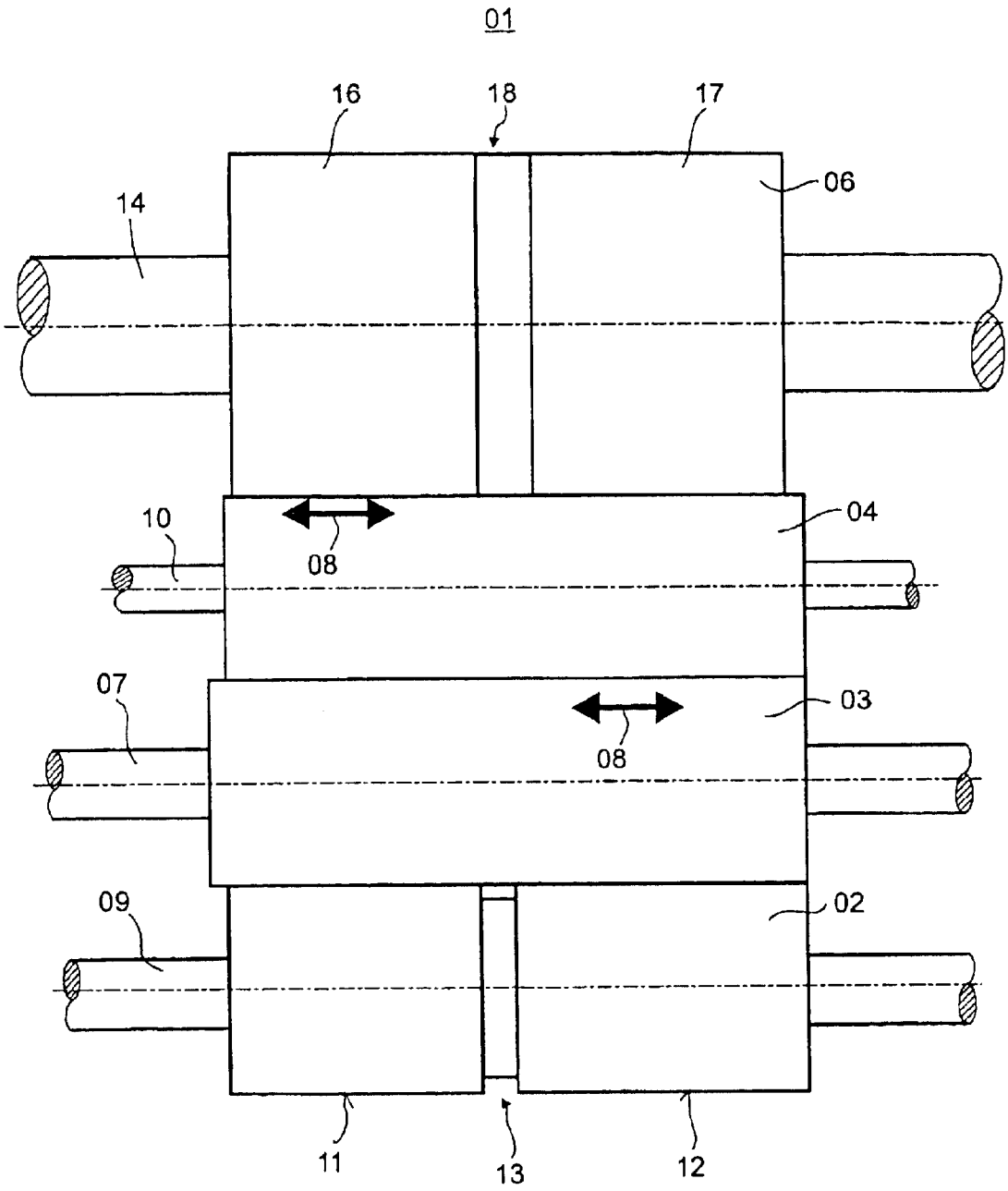
in FIG. 2 a schematic front view of the inking unit of FIG. 1 in a second mode of operation.

FIG. 2 shows the inking unit 01 in a second mode of operation, which is suited for use in the printing of two separated pages, especially with different inks. On the fourth roller 06, which is formed as plate cylinder 06, there are secured two separate printing plates 16, 17, each of which plates 16, 17 is carrying the image of one page to be printed. The two printing plates 16, 17 are separated from one another by a plate spacing distance 18, which spacing distance 18 defines an unprinted region on the paper web to be printed The first or distribution roller 03 oscillates longitudinally again in this second mode of operation with a stroke 08 lying in the range from +/− 5 mm to +/− 10 mm, and especially +/− 7.5 mm, around a middle or center position and receives the printing ink again from the separated roll sections 11, 12 of the axially fixed third roller 02. In order to prevent the printing inks transferred separately from the third roller 02 from being too strongly rubbed, or distributed, the second roller 04 is no longer axially fixed on its shaft 10 in this second, illustrated mode of operation. Rather, the second roller 04 can be displaced in its axial direction. Due to the frictional forces between the first or distribution roller 03 and the second roller 04, the second roller 04 executes essentially the same axial movement as that imparted to the first roller 03. The result is there is essentially no relative movement between these two rollers 03, 04 and the printing ink in the contact area or zone between these two rollers 03, 04 is not vigorously rubbed or distributed.

In this second mode of operation of the first preferred embodiment of the inking unit, the separately applied printing inks from the roll sections 11 and 12 are rubbed, or distributed by the oscillation of the first or distribution roller 03 thus only in the contact zone between the first roller 03 and the third roller 02. Since, however, the width of the recess 13 corresponds to exactly twice the longitudinal stroke length 08 of the first roller 03, and, additionally, since the plate spacing distance 18 between the printing places 16, 17, is selected to be 23 mm, which plate spacing distance 18 is even greater than twice the stroke 08 of the first roller 03, an undesired mixing of the separately applied printing inks can be prevented.

Figure 3:
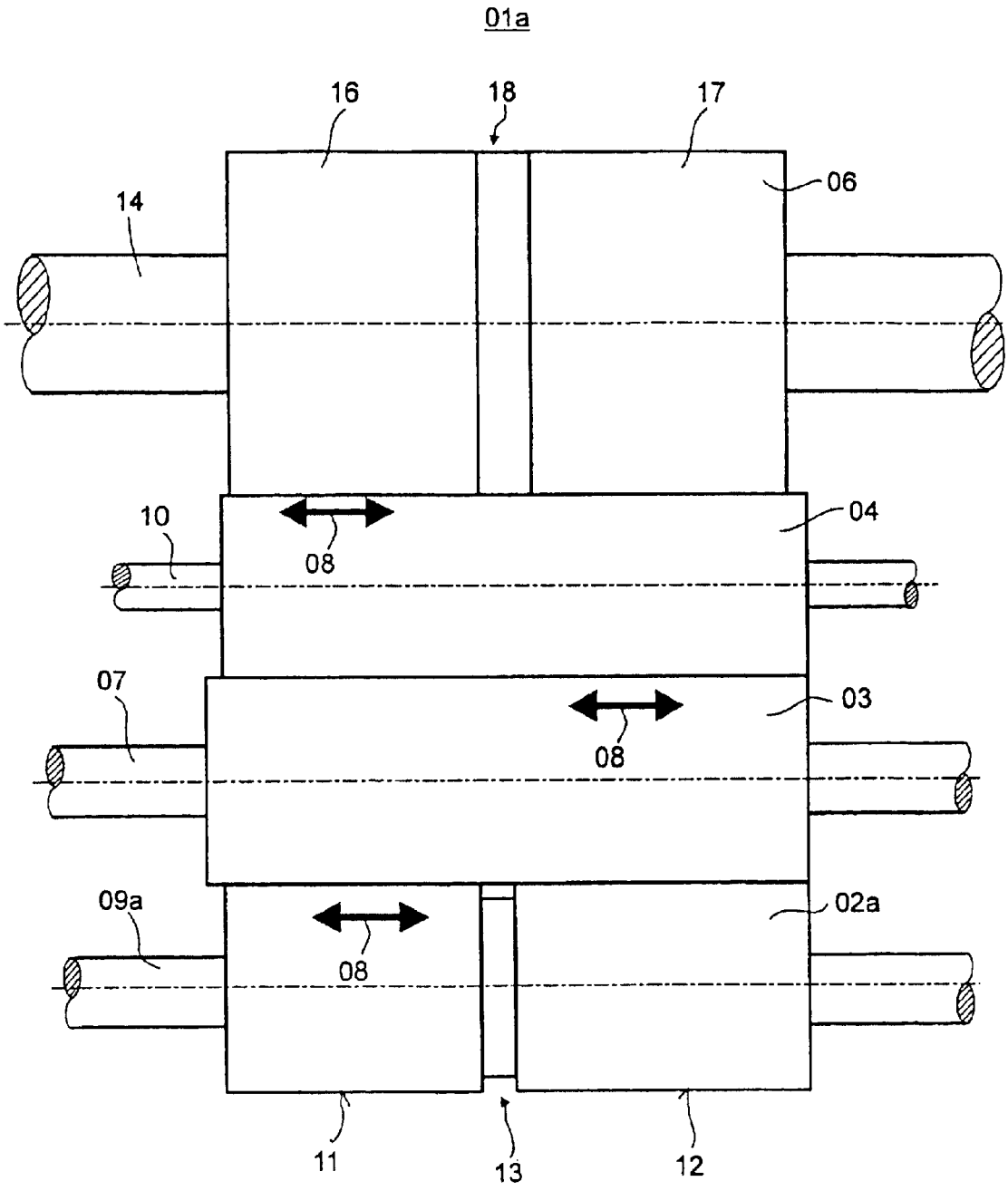
in FIG. 3 a schematic front view of a second preferred embodiment of an inking unit in accordance with the present invention.

FIG. 3 shows a second preferred embodiment of an inking unit in accordance with the present invention, at 01*a*, whose construction corresponds essentially to that of the printing unit 01 of the first preferred embodiment. The difference between the inking units 01 and 01*a* resides in that , the third roller 02*a* of the second inking unit 01*a* can selectively be journaled to be axially displaceable. In this way, in response to oscillation of the first, or distribution roller 03, both the second roller 03 and also the third roller 02*a* are drawn along and caused to move in the axial, longitudinal direction, indicated by arrow 08, so that the ink rubbing or the ink distribution in the contact zones between the rollers 02*a*, 04, 04 is lessened or eliminated, as the case may be.

Figure 4:
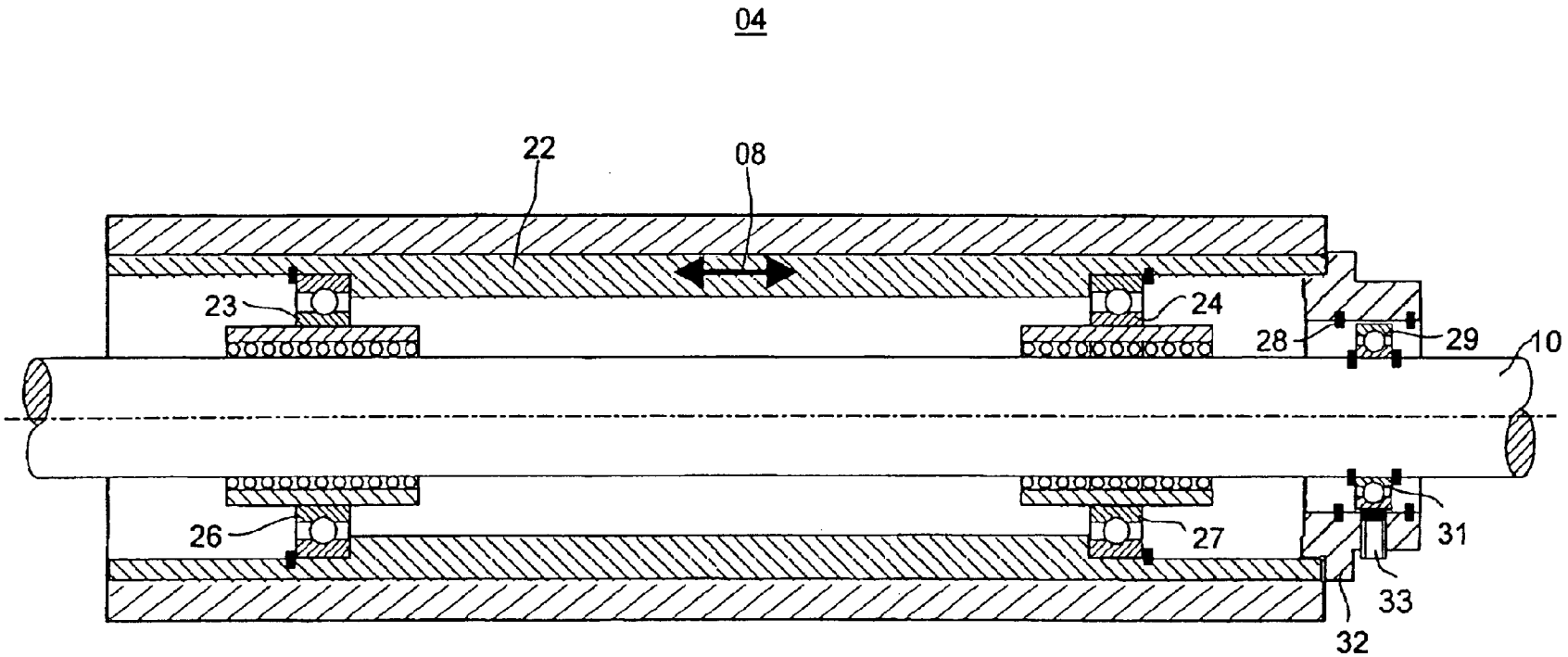
in FIG. 4 a cross sectional view of a roller suitable for use in the inking units of FIGS. 1 and 3.

FIG. 4 shows a cross-section through the second roller 04. Roller 04 is composed essentially of the roller shaft 10, which extends all the way across the roller and whose ends can be journaled in an inking unit frame, which is not specifically shown. A sleeve 22 is rotatably journaled on the shaft 10 by spaced bearings 23, 24, which may be, for example deep groove ball bearings 23, 24. Arranged between the inner rings of the ball bearings 23, 24 and the shaft 10 are bushings 26, 27, which may be, for example ball bushings 26, 27, so that roller sleeve 22 can be displaced axially in the longitudinal direction of the roller 04. The movement of the roller sleeve 22; in the longitudinal direction relative to shaft 10 is limited by two end stops 28, 29, which can be placed laterally spaced with respect to a sleeve bearing 31, which may be, for example a deep groove ball bearing 31, which is secured on the shaft 10 at the outboard ends of the roller sleeve 22. In order to be able to axially fix the roller sleeve 22 relative to shaft 10, there is provided a sleeve flange 32 at each end of sleeve 22. Each sleeve flange 32, as seen in FIG. 4, has a locking screw 33, whose end surface can be tightened against an outer ring of the sleeve ball bearing 31. If the locking screw 33 is released, the sleeve flange 32 can be displaced relative to the outer ring of the sleeve ball bearing 31, whereby an axial movement of the sleeve 22 relative to the shaft 10 is made possible. Tightening of the locking screw 33 axially fixes the sleeve 22 relative to the shaft 10, while the rotational movement of the sleeve 22 with respect to the shaft, as provided by the presence of sleeve ball bearing 31, remains possible.

Figure 5:
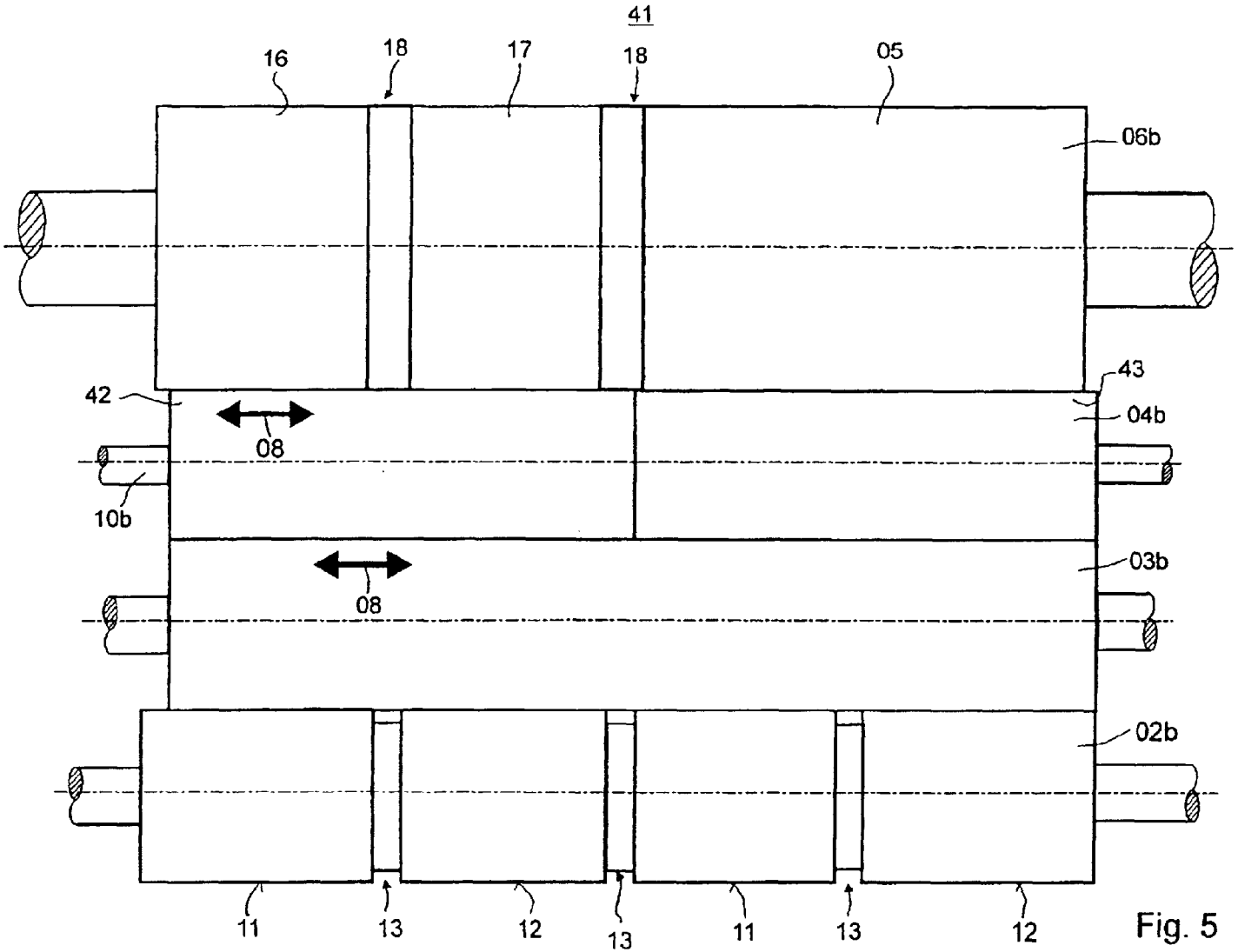
in FIG. 5 a schematic front view of a third preferred embodiment of an inking unit in accordance with the present invention.

FIG. 5 shows a third preferred embodiment of an inking unit 41, in accordance with the present invention, that is suitable for use in a four page wide printing press. In such a four page wide printing press, one has the choice of arranging on the fourth roller 06*b*, which is in the form of a plate cylinder 06*b*, separate printing plates 16, and 17, which may be used for example, to print four separated pages, or printing plates 05, of which is adapted each for two pages of panorama printing. In the operating state illustrated in FIG. 5, the fourth roller 06*b* has one continuous printing plate 05 for panorama printing and two separate printing plates 16, 17 for printing with decorative inks. The first or distribution roller 03b, which is formed in the manner of a distribution cylinder 03*b*, has a width essentially equalling that of the fourth roller 06*b* and is configured having a continuous roll surface. The second roller 04*b* is formed having two adjoining roll sections 42, 43. The roll section 43, which interacts with the fourth roller 06*b* in the region of the printing plate 05 for panorama printing, is fixed on the shaft 10*b* in the operating configuration illustrated in FIG. 5, in order to achieve, from the oscillatory movement 08 of the distribution roller 03*b*, a maximum rubbing or distribution of the printing inks which are applied separately from the third roller 02*b*. Roll section 42, in contrast, is journaled to be axially displaceable on shaft 10*b*, so that it follows the oscillatory movement 08 of the first roller 03*b*, and essentially no rubbing or distribution of the ink occurs in the contact zone between the first roller 03*b* and the roll section 42. The result is that inking unit 41 can print either two panorama print pages, each having two single pages which are printed continuously between one another, four single pages, especially with separate colors, or one panorama page combined with two single pages. Depending on whether the printing plate 05 for the panorama print is located to the left or to the right of the two single print pages, or whether either none or all of the pages are printed in panorama print, conversion simply requires that the two roll sections 42, 43 be axially fixed, or released, as the case may require.

Figure 6:
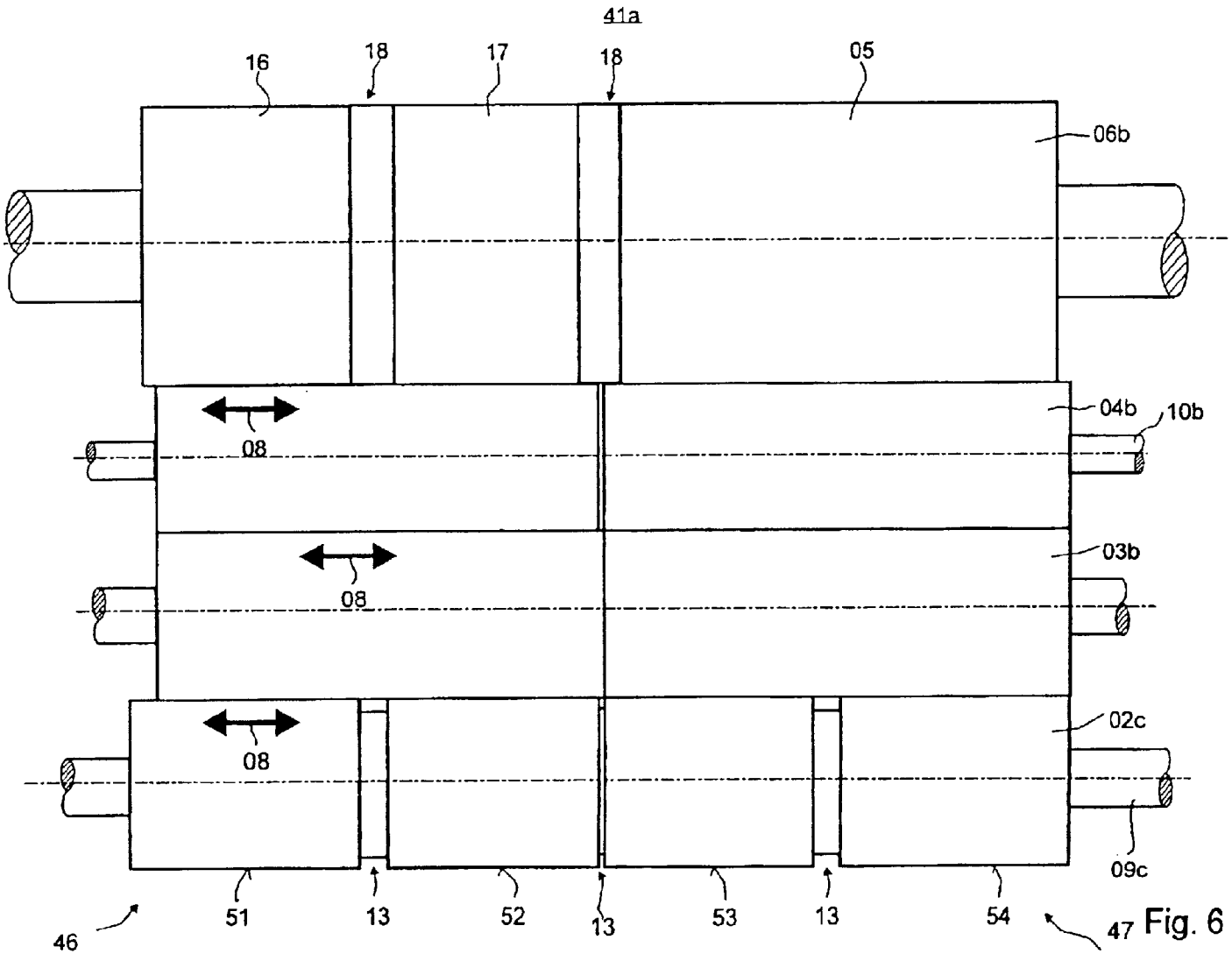
in FIG. 6 a schematic front view of a fourth preferred embodiment of an inking unit in accordance with the present invention.

FIG. 6 shows a fourth preferred embodiment of an inking unit 41*a*, whose construction corresponds essentially to the construction of the third preferred embodiment of the inking unit 41. In contrast to the third inking unit 41, for the fourth inking unit 41*a* the third roller 02*c*, which is in form of an ink metering roller, also has two separated roll sections 46, 47. The two roll sections 46, 47 can, in a similar to the journalling of the two roll sections 42, 43, each be selectively fixed axially on the shaft 09*c* or can be axially displaceable relative thereto. If the two roll sections 46 and 47 are both released, so that they can both axially displace or shift, then the rubbing or distribution of the printing ink in the region of the contact zone between the first roller 03*b* and the third roller 02*c* can be lessened or can be eliminated, as the case may be. Each roll section 46, 47, in turn, is configured having two separated roll surface sections 51, 52 as one set, 53, 54 as the other set, respectively, which roll surface sections 51, 52 and 53, 54 are each separated by an annular groove 13. The two roll surface sections 51, 52, and 53, 54 can be both axially fixed as well as being oscillatory.

Figure 7:
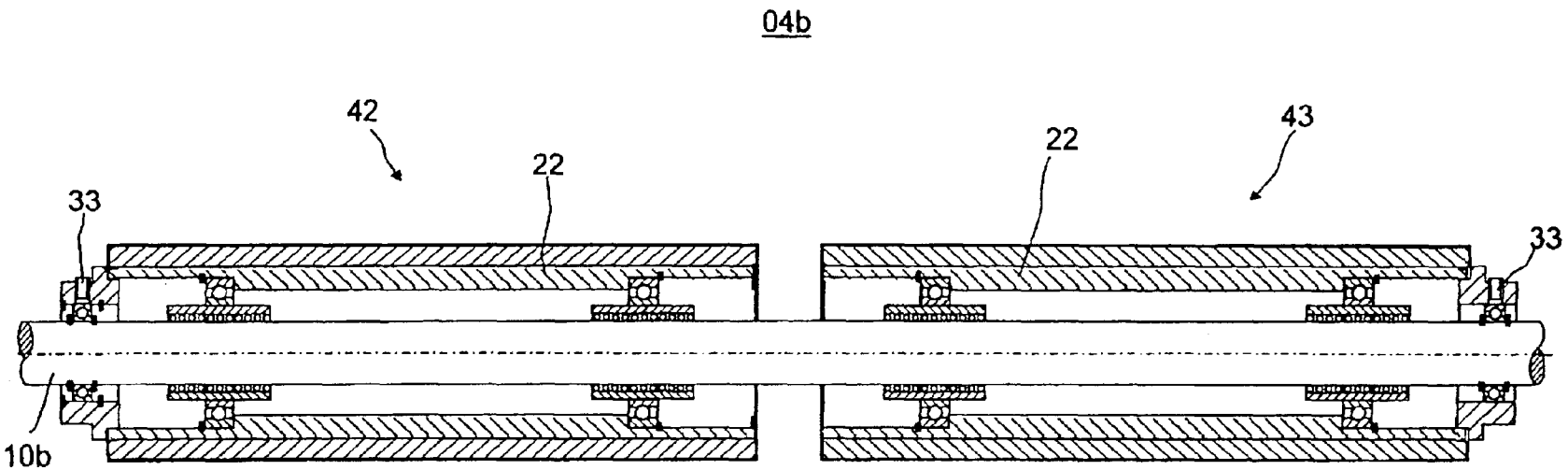
in FIG. 7 a cross sectional view of a first roller suitable for use in the inking units of FIGS. 5 and 6; and in FIG. 8 a cross sectional view of a second roller suitable for use in the inking units of FIGS. 5 and 6.

FIG. 7 shows a cross-section through the second roller 04*b*, in accordance with the third and fourth preferred embodiments, with a shaft 10*b* extending from one end to the other. The two roll sections 42, 43 are each formed by a sleeve 22, which, in a manner the same as was discussed for roller 04 of FIG. 4, are journaled on the shaft 10*b* by the use of the deep groove ball bearings 23, 24, and the use of the ball bushings 26, to be rotatable and axially displaceable. Tightening of the locking screws 33 permit the two roll sections 42, 43 of roller 04*b* to each be axially fixed on the shaft 10*b* independently of one another.

Figure 8:
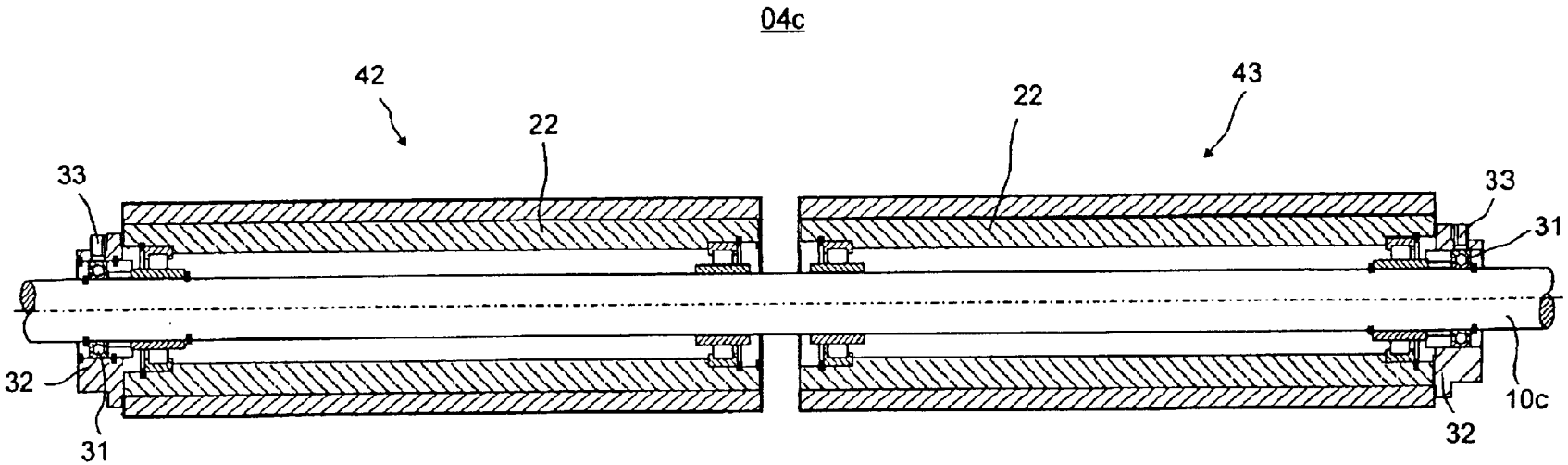

FIG. 8 shows a cross-section of a further configuration of a second roller 04*c* that can be used in an inking unit 41 or 41 a for a four page wide printing press. Instead of combining one deep groove ball bearing 23, 24 with one ball bushing 26, 27, for each sleeve 22, as depicted in FIGS. 4 and 7, in the configuration of FIG. 8 the sleeves 22 of the roll sections 42, 43 are each journaled with two bearings 49, for example with needle bearings 49, on the shaft 10*c*. The needle bearings 49 permit both a rotational and an axial relative movement of the sleeves 22 relative to the shaft 10*c*. Again, sleeve flanges 32 contain locking screws 33 for use in fixing the roll sections 42, 42, at the locations of the deep groove ball bearings 31, on the shaft 10*c*.

While preferred embodiments of an inking unit with rollers, in accordance with the present invention, have been set forth fully and completely hereinabove, it will be apparent to one of skill in the art that various changes in, for example the specific type of printing ink being used, the overall press structure, and the like could be made without departing from the true spirit and scope of the present invention which is accordingly to be limited only by the following claims.

What is claimed is:

1. An inking unit comprising:

at least one roller;

a roller barrel on said at least one roller;

at least two separate roll sections on said roller barrel; and means supporting at least one of said roll sections for oscillating movement in a longitudinal direction of said at least one roller independent of the other of said at least two separate roll sections.

2. The inking unit of claim 1 further including an axially shiftable roller having a longitudinal displacement stroke, said axially shiftable roller being arranged in driving contact with said roller having said at least two separate roll sections.

3. The inking unit of claim 1 wherein in a first mode of operation said one roll section is in oscillating movement and the other of said at least two separate roll sections is fixed.

4. The inking unit of claim 1 wherein said other of said at least two separate roll sections is in oscillating movement and said one roll section is axially fixed.

5. The inking unit of claim 1 wherein both of said roll sections are axially fixed.

6. The inking unit of claim 1 wherein both of said rolls sections axially oscillate.

7. The printing unit of claim 2 wherein said axially shiftable roller is a distribution cylinder.

8. The inking unit of claim 1 further including an ink forme roller.

9. The inking unit of claim 1 further including an ink metering roller.

10. The inking unit of claim 2 wherein said at least two roll sections are separated by a recess.

11. The inking unit of claim 10 wherein said recess has a width equal to at least twice said stroke.

12. The inking unit of claim 2 further including a further roller supported for rotation and engageable with said axially displaceable roller.

13. The inking unit of claim 12 wherein said further roller is selectively one of a plate cylinder and an ink metering roller.

14. The inking unit of claim 2 wherein said stroke has a length of between 5 mm and 10 mm.

15. The inking unit of claim 14 wherein said stroke has a length of 7.5 mm.

16. The inking unit of claim 1 wherein said rollers are in frictional driving contact.

17. The inking unit of claim 1 wherein said inking unit is adapted to apply ink to a printing press having at least four plates arranged alongside each other.

18. The inking unit of claim 10 wherein each of said at least two roll sections are separated into two separated roll surface sections.

19. The inking unit of claim 1 wherein said roller barrel includes a shaft and at least two sleeves arranged on said shaft, said sleeves forming said at least two roller sections.

20. The inking unit of claim 19 wherein said sleeves are each supported on said shaft for axial displacement on said shaft.

21. The inking unit of claim 20 further including end stops on said shaft, said end stops limiting said axial displacement of said sleeves.

22. The inking unit of claim 19 further including deep groove ball bearings interposed between said sleeves and said shaft, each said deep groove roller bearing having a first ring on said shaft and a second ring on said sleeve, one of said first and second rings further including a fixing means.

* * * * *